US012330011B2

(12) United States Patent
Malcolm

(10) Patent No.: US 12,330,011 B2
(45) Date of Patent: Jun. 17, 2025

(54) ERGONOMIC HANDHELD WEIGHT UNIT AND METHOD OF USE

(71) Applicant: Christian Malcolm, Thousand Oaks, CA (US)

(72) Inventor: Christian Malcolm, Thousand Oaks, CA (US)

( * ) Notice: Subject to any disclaimer, the term of this patent is extended or adjusted under 35 U.S.C. 154(b) by 0 days.

(21) Appl. No.: 17/901,400

(22) Filed: Sep. 1, 2022

(65) Prior Publication Data

US 2023/0076880 A1 Mar. 9, 2023

Related U.S. Application Data

(63) Continuation of application No. 16/952,048, filed on Nov. 18, 2020, now abandoned, which is a (Continued)

(51) Int. Cl.
*A63B 21/072* (2006.01)
*A63B 21/00* (2006.01)
(Continued)

(52) U.S. Cl.
CPC ..... *A63B 21/072* (2013.01); *A63B 21/0604* (2013.01); *A63B 21/065* (2013.01);
(Continued)

(58) Field of Classification Search
CPC ..... A63B 21/065; A63B 21/4019; A63B 21/4035; A63B 21/4039; A63B 21/00058; A63B 21/00061; A63B 21/00065; A63B 21/06; A63B 21/0601; A63B 21/0602–0604; A63B 21/0607; A63B 21/072–075; A63B 2220/803; A63B 2220/833; A63B 2220/34; A63B 2220/40; A63B 2225/54; A63B 2225/09; A63B 69/0028; A63B 23/16; A63B 71/0054; A63B 2071/065; A63B 2209/00; A63B 2209/10; A63B 2230/75
See application file for complete search history.

(56) References Cited

U.S. PATENT DOCUMENTS 4,351,526 A * 9/1982 Schwartz ..... A63B 21/4019 482/108
4,929,211 A * 5/1990 Resnick ..... A63B 23/16 446/14
(Continued)

FOREIGN PATENT DOCUMENTS

DE 10 2008 038575 A1 10/2009

OTHER PUBLICATIONS

WO, PCT/US19/35886 ISR and Written Opinion, Sep. 3, 2019.
(Continued)

*Primary Examiner* — Loan B Jimenez
*Assistant Examiner* — Kathleen M Fisk
(74) *Attorney, Agent, or Firm* — ONE LLP

(57) ABSTRACT

Systems and methods for a small light weight unit that can be securely held and centered in the palm of the holder during physical activities, such as exercises, including aerobic exercises. The weight unit also includes features for securing the weight in the palm during the exercise to achieve a specific desired weight and intensity of workout.

8 Claims, 11 Drawing Sheets

Related U.S. Application Data continuation of application No. PCT/US2019/035886, filed on Jun. 6, 2019.

(60) Provisional application No. 62/682,707, filed on Jun. 8, 2018.

(51) Int. Cl.
*A63B 21/06* (2006.01)
*A63B 21/065* (2006.01)
*A63B 21/075* (2006.01)

(52) U.S. Cl.
CPC ..... *A63B 21/075* (2013.01); *A63B 21/4019* (2015.10); *A63B 21/4039* (2015.10); *A63B 2220/803* (2013.01); *A63B 2220/833* (2013.01); *A63B 2225/54* (2013.01)

(56) References Cited

U.S. PATENT DOCUMENTS 5,242,350 A * 9/1993 Chang ..... A63B 21/075 482/93
5,401,225 A 3/1995 Ko
5,890,999 A 4/1999 Kildani
7,458,921 B2 * 12/2008 Hallar ..... A63B 21/0726 482/106
7,628,735 B1 12/2009 Hsu
9,616,286 B1 4/2017 Zamarripa
2004/0063554 A1 * 4/2004 Wince ..... A63B 21/0724 482/109
2005/0137064 A1 * 6/2005 Nothnagle ..... A63B 21/4035 482/108
2007/0087917 A1 * 4/2007 Kemery ..... A63B 21/072 482/106
2008/0220942 A1 * 9/2008 Boese ..... A63B 21/0004 482/51
2009/0247369 A1 * 10/2009 Chang ..... A63B 21/06 482/105
2010/0178981 A1 7/2010 Holcomb et al.
2010/0183814 A1 * 7/2010 Rios ..... A63B 60/00 427/387
2011/0281688 A1 11/2011 Harris et al.
2012/0179226 A1 7/2012 Graham et al.
2014/0243169 A1 * 8/2014 Justice ..... A63B 21/4035 482/106
2015/0343260 A1 * 12/2015 Rohanna ..... A63B 21/0726 482/50
2017/0361159 A1 12/2017 Malcolm
2018/0178061 A1 * 6/2018 O'Larte ..... A61B 5/318
2019/0001182 A1 * 1/2019 St. Jeor ..... A63B 21/4035
2019/0060697 A1 * 2/2019 Niceley ..... A41D 19/002

OTHER PUBLICATIONS

EP, EP 19815643.2 European Search Report, Jan. 18, 2022.
CN, CN 201980038260.9 Office Action, Oct. 9, 2022.
BR, BR112020025044-9 Office Action, May 23, 2023.
"Hand-held Weighted Balls" (Fabrication Enterprises Inc.) Sep. 14, 2014; Retrieved from the Internet on Jul. 30, 2019. URL: <https://www.fabent.com/exercise/weights/hand-held-weighted-balls/>.
EP, 24216629.6 Extended Search Report, Mar. 31, 2025.

* cited by examiner

ERGONOMIC HANDHELD WEIGHT UNIT AND METHOD OF USE

CROSS-REFERENCE TO RELATED APPLICATIONS

The present application is a continuation of U.S. patent application Ser. No. 16/952,048, filed Nov. 18, 2020, which is a continuation of International Application No. PCT/US19/35886, filed Jun. 6, 2019, which claims the benefit pursuant to 35 U.S.C. § 119(e), to U.S. Provisional Patent Application No. 62/682,707, filed Jun. 8, 2018, the disclosures of both which are incorporated herein by reference in their entireties.

FIELD

The present disclosure relates to handheld exercise weights, and more particularly to hand weights having specific ergonomic shapes that allow for the centering of weight in the palm of the hand of a user, and having features for securing the weight in the palm during an aerobic exercise to achieve a specific desired weight and intensity of workout.

BACKGROUND

Aerobic exercise has always been an effective way to lose weight, increase physical conditioning, and maintain a healthy lifestyle. However, over time, the body adjusts to the aerobic exercise by increasing both strength and physical endurance, making the same activity easier and easier to perform. Therefore, to maintain a high level of physical exertion during aerobic exercises, weight or resistance must be added or increased over time to keep up with the body's increased physical conditioning.

Adding held weight to any aerobic activity is a great way to accomplish such addition of weight or resistance. There exists a wide variety of indoor and outdoor exercises that are made more challenging when even the smallest amount of held weight is added to the activity. Increasing the heart rate, muscle activity, and total calories burned per hour is possible with the addition of dumbbells or various methods of holding weight in the hand during physical activities.

A conventional dumbbell is intrinsically formed as a single solid unit formed with a center grip bar with weight blocks attached at both ends, the larger the weight the larger the outer weight blocks or segments become. Therefore, these traditional dumbbell shapes are not advantageous during physical activities, especially aerobic activity, as they often alter the form of the exercise to limit the risk of banging the weights together or coming in contact with the body. In addition, traditional dumbbell shapes can come in contact with aerobic machines such as treadmills or step climbers during certain arm movements or motions, can get hung up or caught on headphone wires during exercise, and can hit a walking or running partner's dumbbell or body as they are swung back and forth by the holder when exercising in a group.

Therefore, there exists a need for a handheld weight system in which most of the weight is centered in the palm without the above-mentioned and other disadvantages. In addition to the single weight unit being centered in the palm of the hand, it is also more advantageous for the user when the weight unit can be securely held in the palm during the physical activity.

SUMMARY

Provided herein are example embodiments of systems, devices and methods to provide a small light weight unit that can be securely held and centered in the palm of the holder during physical activities, such as exercises, including aerobic exercises. The weight unit also includes features for securing the weight in the palm during the exercise to achieve a specific desired weight and intensity of workout.

Generally, the present disclosure provides an exercise weight unit that when held by a user is centered over the palm. In some embodiments, the weight unit may be in a rounded or oval shape and having a protrusion ("fin" or "hump") extending from one end of the oval shape to the other end. A rounded egg or oval shaped weight unit, centered over the palm, can help reduce the tendency for the user to clench his or her fist tightly around a thin centered bar grip (such as of a dumbbell) and thus can reduce or eliminate the risk of increasing blood pressure during physical activity, e.g., aerobic exercise. Therefore, when an individual chooses to perform physical activities, e.g., exercising, walking or running with weights for the added training benefit, it is most advantageous to hold a weight that is specifically designed to be ergonomically and securely centered in the palm of the hand and for a light gentle holding thereof during prolonged physical activity, e.g., aerobic exercise.

In some embodiments, the weight unit may comprise an elongated main body having a first end and a second end, a central portion, and a central axis through the first end and the second end, and a protrusion extended away from an outer surface of the main body and extending from the first end of the solid unit to the second end of the solid unit along a base. The width of the protrusion may be smaller than the diameter of the main body. In some embodiments, the protrusion forms an arc shape along a top edge of protrusion.

In some embodiments, the exercise weight unit may further include at least one of a hand strap, a hook and loop material wrap (e.g., VELCRO™ wrap), a neoprene grip, a rubber flexible wrap, a rubber gel filled grip, and a glove. In some embodiments, the hand strap, hook and loop material wrap (e.g., VELCRO™ wrap), neoprene grip, rubber flexible wrap, and rubber gel filled grip may include one or more finger loops.

In some embodiments, the exercise weight unit may further include a removable finger loop grip strap. The removable finer loop grip strap may be affixed to the main body with two screws which are screws into two screws holes on the main body. The removable finger loop grip strap may include two elongated openings through which the two screws may be inserted. The elongated shape of the openings may allow the height of finger loop to be adjustable.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Moreover, it is noted that the invention is not limited to the specific embodiments described in the Detailed Description and/or other sections of this document. Such embodiments are presented herein for illustrative purposes only. Additional embodiments will be apparent to persons skilled in the relevant art(s) based on the teachings contained herein.

BRIEF DESCRIPTION OF THE DRAWINGS

The accompanying drawings, which are incorporated in and constitute a part of the specification, are for illustrative purposes only of selected embodiments, serve to explain the principles of the invention. These drawings do not describe all possible implementations and are not intended to limit the scope of the present disclosure.

DETAILED DESCRIPTION

Figure 1:
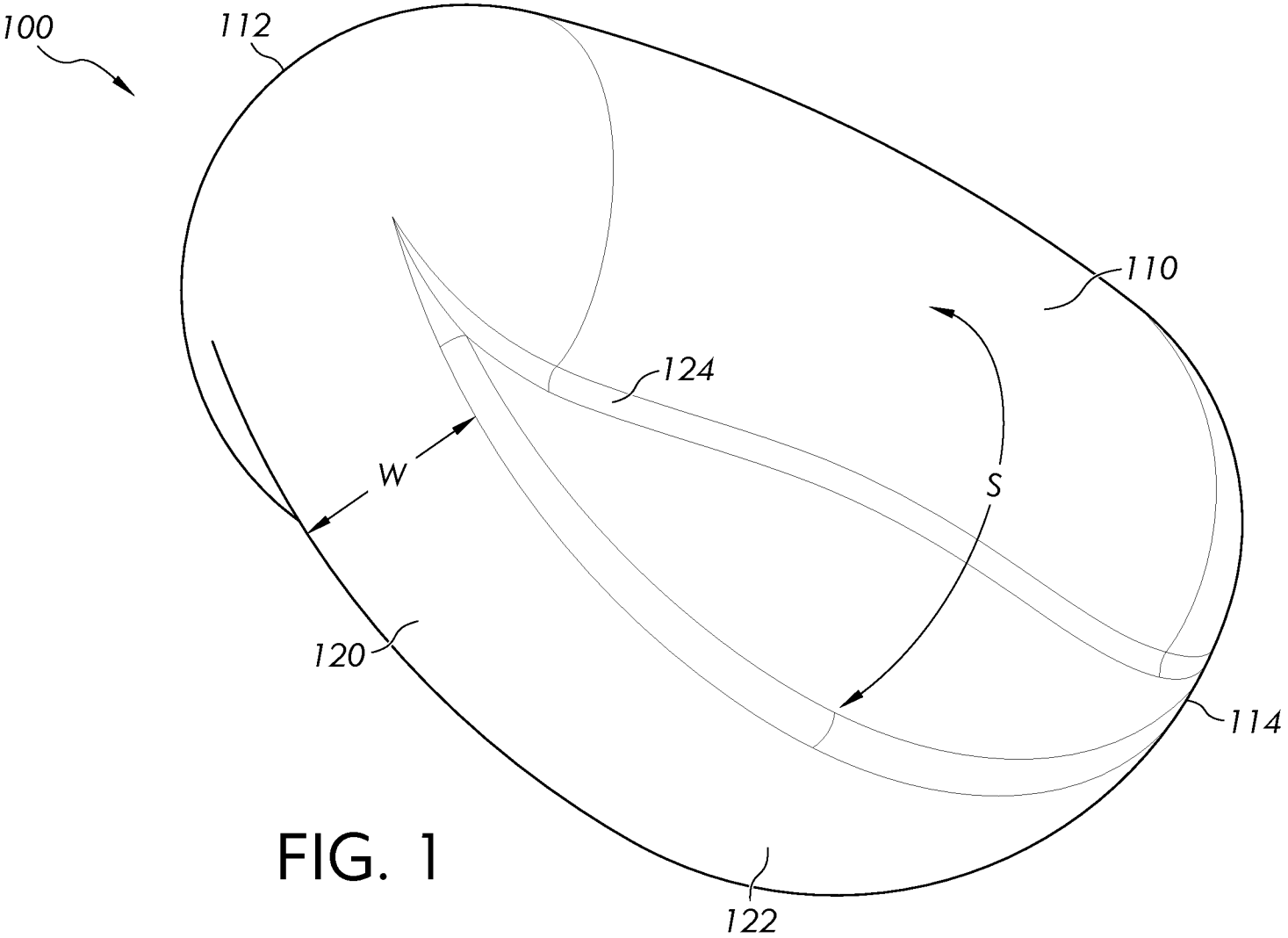
FIG. 1 illustrates an exemplary perspective view of an exercise weight unit, according to some embodiments.

The present disclosure relates to systems, devices and methods for small light weight unit that can be securely held and centered in the palm of the holder during physical activities, for example, exercises.

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way, but rather as merely describing the implementation of the various embodiments described herein.

FIG. 1 illustrates an exemplary perspective view of an exercise weight unit 100, according to some embodiments of the present disclosure. In some embodiments, the present disclosure may provide a small light weight unit 100 in a rounded or oval shape main body 110. The main body includes an end 112, and end 114, a central axis through the two ends, and a central portion between the two ends. The weight unit may include an elongated protrusion ("fin" or "hump") 120 protruding from one side of the weight unit main body at base 124 and extending from one end 112 of the body to the other end 114 of the body. The elongated protrusion 120 may have a width W that is smaller than the diameter of the main body 110 at the central portion, forming a space S between the surface of the main body 110 and the elongated protrusion 120.

The elongated protrusion 120 may have an arc shape at the top 122 of the protrusion 120 (the top 122 is on the edge that is away from the main body 110). One advantage of providing the elongated protrusion 120 may be to reduce the diameter of the weight unit main body 110, for example, the body 110 does not have to extend to cover the space S from the body to the top of the protrusion 120. Alternatively or in addition, another advantage of providing the elongated protrusion 120 may be to add more material to the weight unit.

Figure 2:
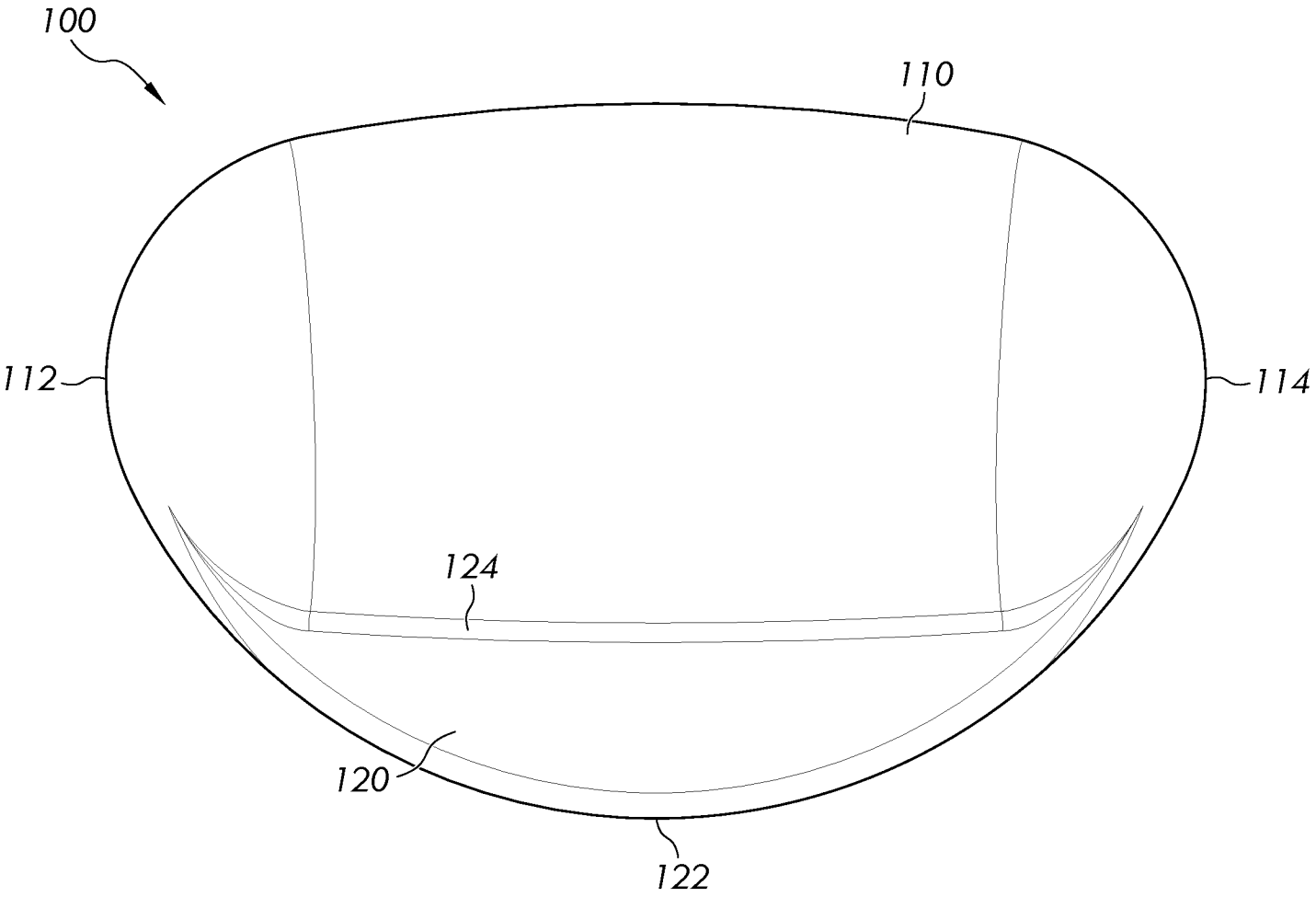
FIG. 2 illustrates an exemplary side view of an exercise weight unit, according to some embodiments.

FIG. 2 illustrates an exemplary side view of the exercise weight unit 100 showing the elongated protrusion 120 at the bottom of the weight unit 100, according to some embodiments of the disclosure.

Figure 3:
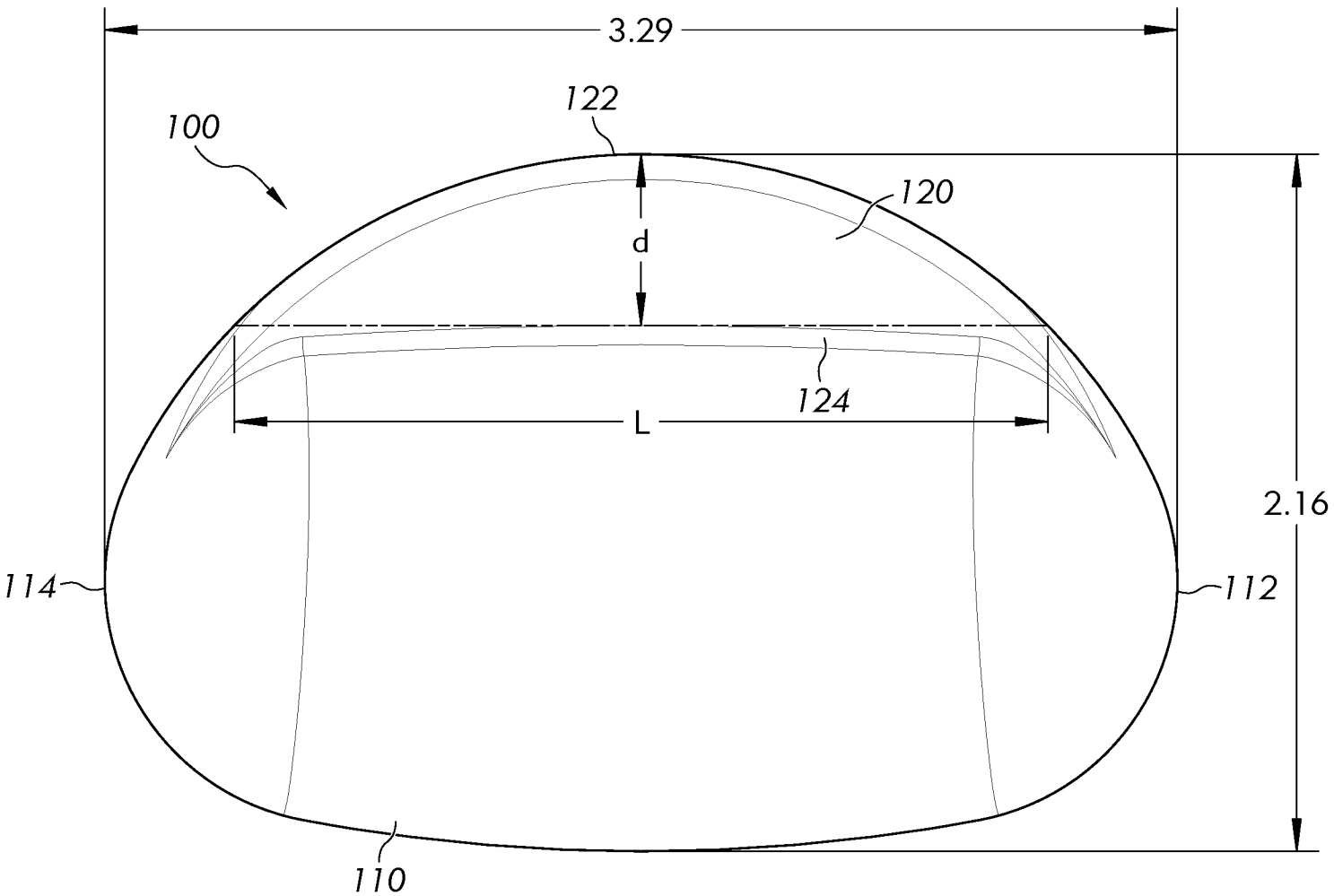
FIG. 3 illustrates another exemplary side view of the exercise weight unit showing the weight unit of FIG. 2 turned 180 degrees upward, according to some embodiments.

FIG. 3 illustrates an exemplary side view of the exercise weight unit 100 showing the elongated protrusion ("fin" or "hump") 120 turned 180 degrees upward, so that the elongated protrusion 120 is shown at the top, according to some embodiments of the disclosure. FIG. 3 also illustrates exemplary dimensions (in inches) of the weight unit. The advantageous dimensions of the weight unit may range from, for example, 70 to 85 mm in length (from end 112 to end 114) with a diameter of the main body 110, at the largest portion of the main body, of for example 30 to 50 mm and vary by size and shape to reach a specific weight increment without exceeding a comfortable or natural grip. The protrusion feature 120 runs along length of the weight unit from each end 112 and 114 and meets in the middle forming an arc. The advantageous dimensions of the arc may be, for example, approximately 10 to 25 mm in width (W), approximately 60 to 85 mm in length (L) at the base 124, and 5 to 25 mm in depth (d) at the deepest point (top of the protrusion 120 to the base 124). The volume of the protrusion 120 may represent an increase in the weight unit (if without the protrusion) from, for example, 0.25 to 0.75 pounds depending on the material, for example metal, and density of the weight unit and the shape and size of the protrusion. The dimensions of the weight unit may allow the weight unit to be centered in the palm of a user who is holding the weight unit in his or her hand. As such, a person with skill in the art will understand that the dimensions shown are examples and are not limiting.

Figure 4:
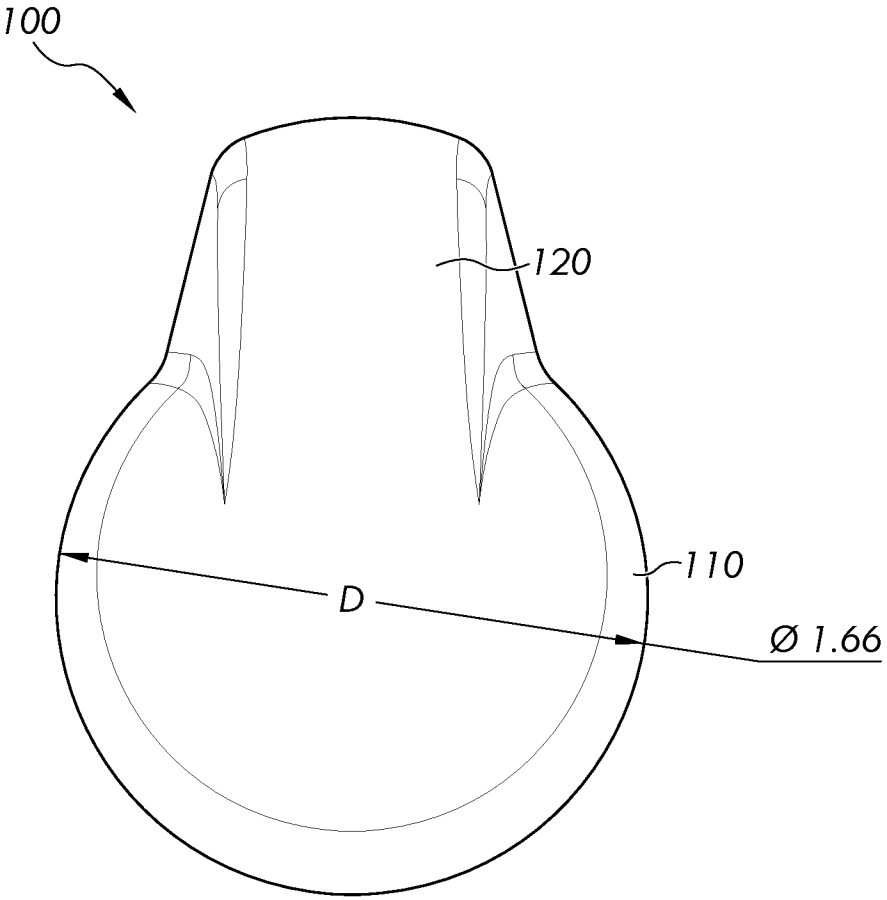
FIG. 4 illustrates an exemplary front view of an exercise weight unit, according to some embodiments.

FIG. 4 illustrates an exemplary front view of the exercise weight unit 100, according to some embodiments of the disclosure. FIG. 4 also illustrates an exemplary dimension (for example, 1.66 inches) of the diameter (D) of the weight unit main body 110. The dimensions of the weight unit may allow the weight unit to be centered in the palm of a user who is holding the weight unit in his or her hand. As such, a person with skill in the art will understand that the dimensions shown are examples and are not limiting.

Figure 5:
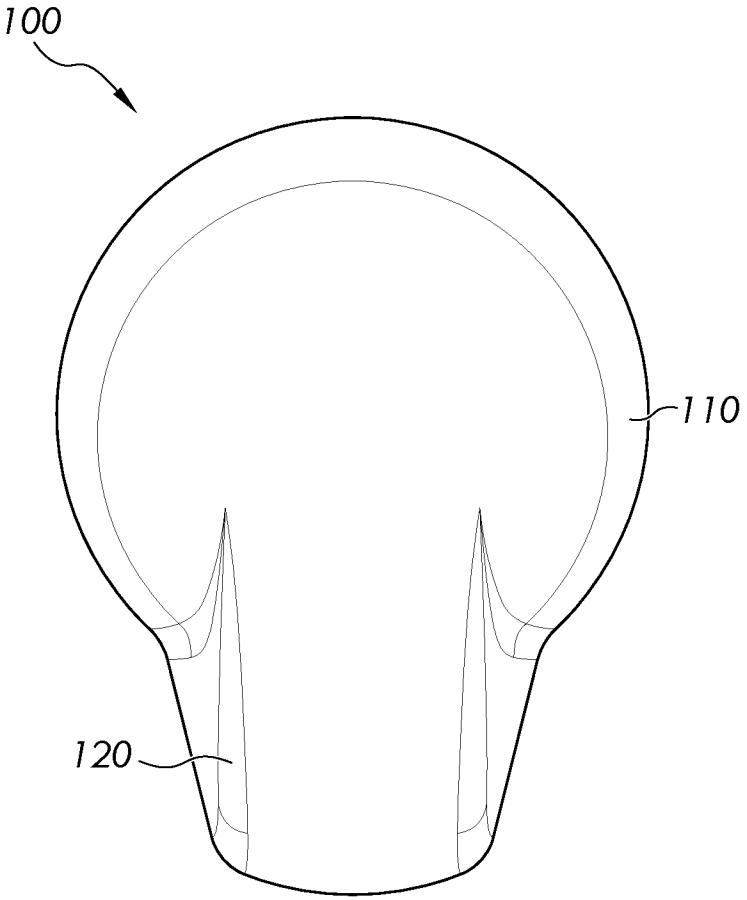
FIG. 5 illustrates another exemplary front view of the exercise weight unit showing the weight unit of FIG. 4 turned 180 degrees downward, according to some embodiments.

FIG. 5 illustrates another exemplary front view of the exercise weight unit 100 showing the weight unit of FIG. 4 turned 180 degrees downward, so that the elongated protrusion 120 is shown at the bottom, according to some embodiments of the disclosure.

Figure 6:
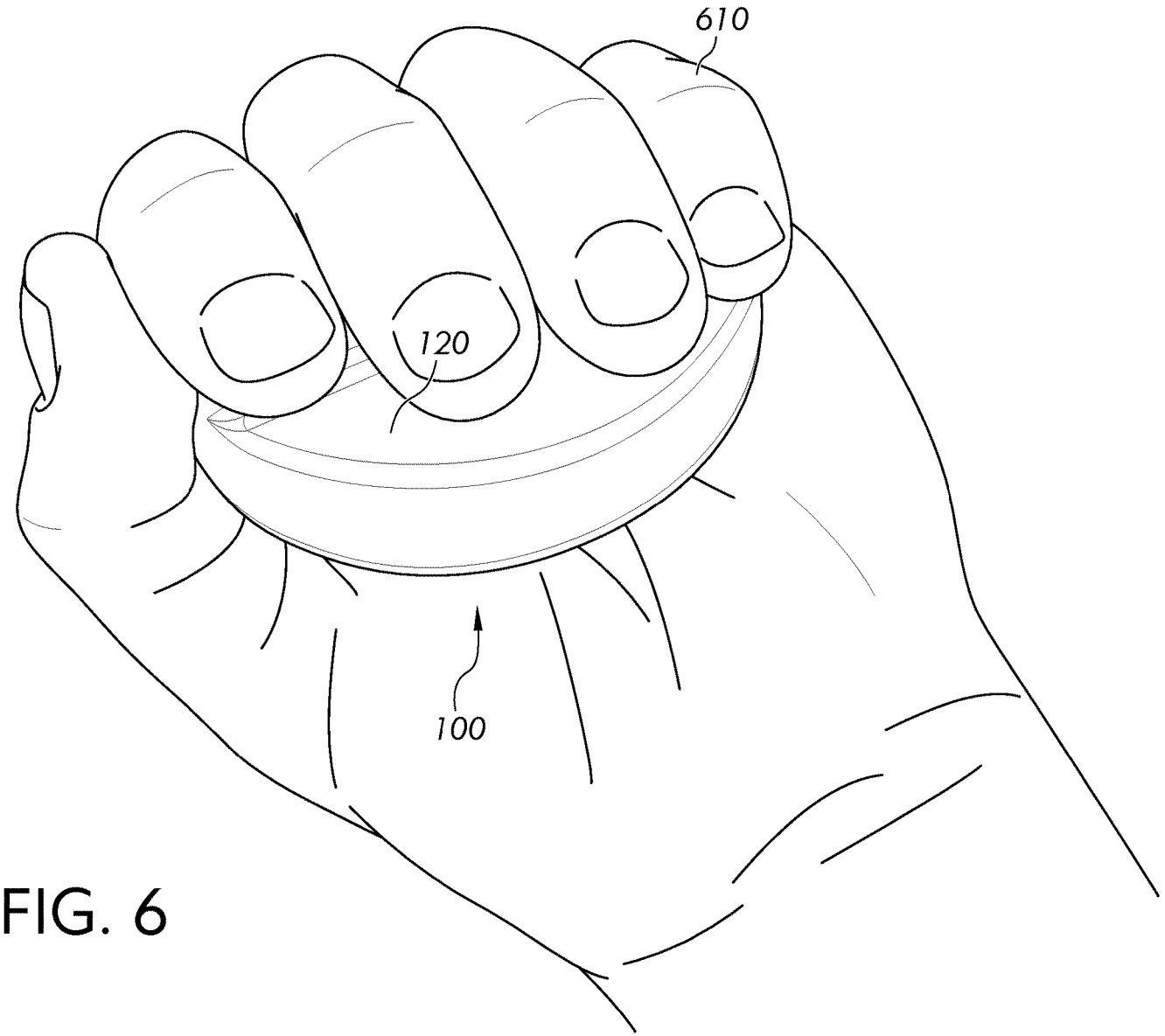
FIG. 6 illustrates an exemplary view of an exercise weight unit being held by a user's hand, according to some embodiments.

FIG. 6 illustrates an exemplary view of the exercise weight unit 100 being held by a user's hand, according to some embodiments of the disclosure. As shown, the protrusion feature 120 protrudes from the weight unit 100 in between the open area of the closed fist surrounding the weight unit 100. In some exemplary operations, when the exercise weight unit being held by a user's hand 610, the protrusion of the weight unit may fit into the gap between the user's fingers and the thumb when the hand is closed. The protrusion may also allow for increased grip support along the metacarpal bones of the thumb when the hand is fully closed around the weight unit. This is critical as it stabilizes the weight unit in the hand during physical activity and also spreads the weight of the unit across multiple bones to limit injury due to an unbalanced weight distribution or forced tight grip. As mentioned, the ergonomic palm centered hand weight unit may utilize the protrusion (or fin or hump) feature to increase the volume of the weight unit without increasing the grasp diameter of the user's hand. In some embodiments, utilizing the gap and the protrusion allows for the addition of volume and weight to the weight unit. The protrusion may provide further support for the thumb.

In some embodiments, the weight unit may be made of suitable metals or alloys and the weight vary in increments based on critical dimensions provided. For example, based on the metal used, the weight may be as follow:

- Cast Iron with a density of 6.85-7.75 g/cm3—¾ to 1.5 pounds
- Stainless Steel with a density of 7.95 g/cm3—1.25 to 2.0 pounds
- Brass with a density of 8.5 g/cm3—1.5 to 2.5 pounds
- Bronze with a density of 8.5-8.9 g/cm3—1.5 to 2.5 pounds
- Copper with a density of 8.9 g/cm3—1.5 to 2.5 pounds
- Bismuth with a density of 9.79/cm3—1.75 to 2.75 pounds.

In some embodiments, depending on the desired weight unit increment and the cost of the raw material, any number of raw metals or alloy combinations may be used to construct it. The size and shape may be altered slightly to adjust for material composition and shrink after forging or processing. The advantageous use of the protrusion feature may allow for inexpensive metal or alloys to increase volume and weight without utilizing more dense metals such as tungsten or tungsten alloys.

Figure 7:
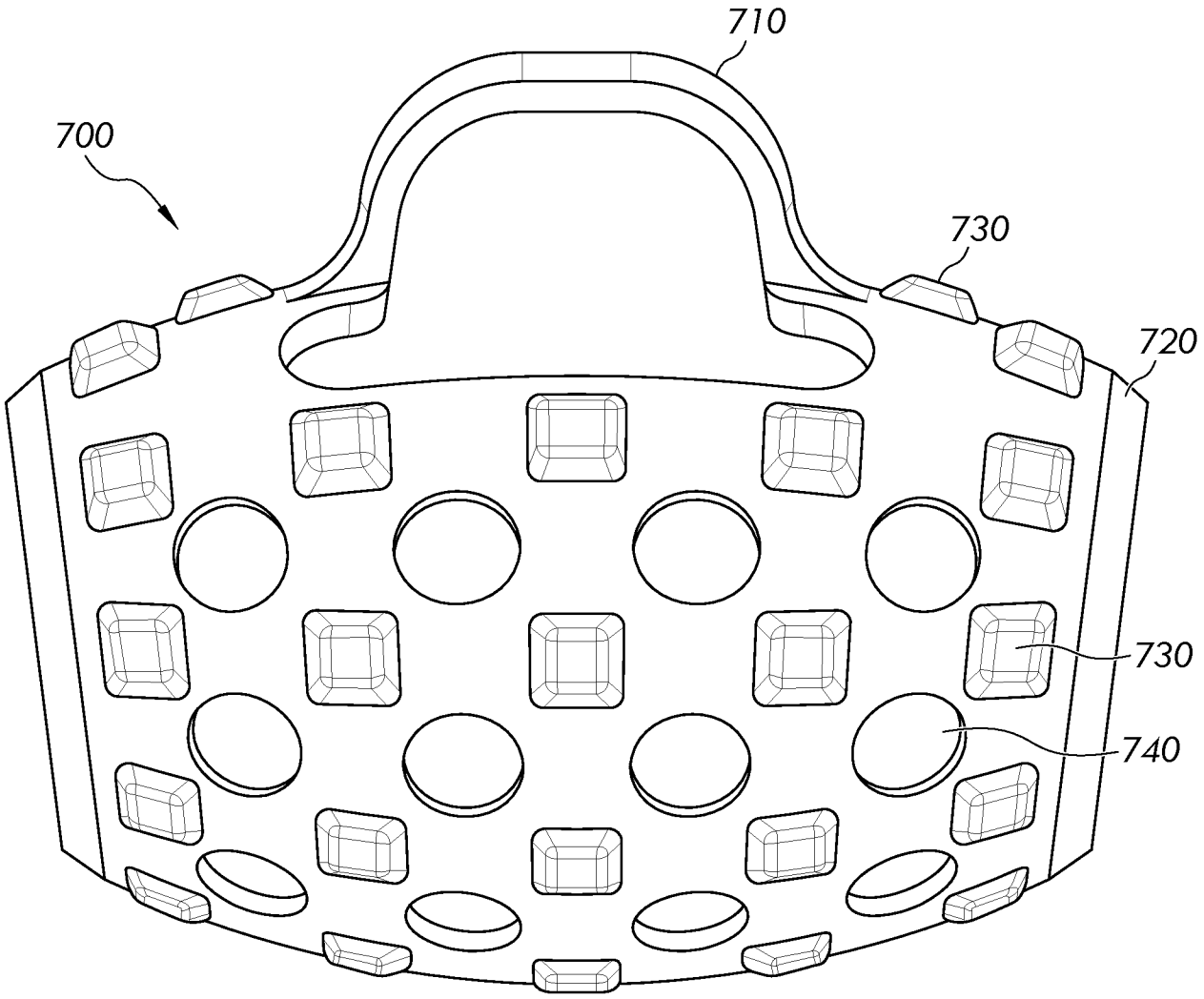
FIG. 7 illustrates an exemplary side view of a hand strap for a weight unit, according to some embodiments.

In some embodiments, the present disclosure may include light weight hand straps, hook and loop material wraps (e.g., VELCRO™ wraps), neoprene grips, rubber flexible wrap, rubber gel filled grips, or gloves to securely hold the weight unit centered in the palm during high-speed arm movements, such as aerobic exercises, sprinting or swimming. FIG. 7 illustrates an exemplary side view of a rubber flexible wrap 700, according to some embodiments of the disclosure. The wrap 700 may include one or more finger loops 710, and a wrap body 720. FIG. 7 shows an example of a one-finger loop. A larger loop may fit more than one finger. The wrap body 720 may removably and fitly wrap around a weight unit (see FIG. 9).

FIG. 7 also shows a pattern of raised nodules 730 along the wrap (or grip), in some embodiments, to provide additional area for contact with the hand, providing greater surface adhesion especially when the weight unit is used with high intensity movements, for example during physical exercises like running, shadowboxing, and plyometric exercises where a high degree of perspiration will be present. The nodules are not limited to any number, size, or shape. To assist in removal of perspiration from the hand during use, a series of holes 740 or indentations or raised lines (not shown) may also be used to allow for the evacuation or reduction of perspiration buildup in the hand during use. These holes 740 may also provide additional stretch or flex to the wrap when inserting the weight unit, providing a dual purpose and use.

The size of the finger loop 710 may change to fit various finger sizes (may be ring sizes) or accommodate several fingers at one time. In addition, the grip or wrap may be constructed as a universal grip or wrap with a specific amount of flex or stretch in the material used, for example silicone rubber, to allow for multiple finger sizes (ring sizes) to fit and hold a grip comfortably in the hand. A range of silicone rubber hardness for this particular advantageous universal grip may be 40-60 Shore A on the hardness scale. This range of hardness may allow not only for the grip to be stretched over the weight unit during assembly but also may allow for users with varying finger sizes to hold the unit comfortably in the hand without cutting off blood flow to the finger or fingers during use. The silicone rubber, or the like, may also be constructed by varying colors and or clarity of rubber. This is particularly advantageous when users want to either customize a colored grip or to see a logo or name engraved or painted on the weight unit body. The ability to customize or brand the weight unit and have said logo or brand be visible may be a critical component to offering customization or brand partnerships with other fitness companies, for example Nike™, New Balance™, or Adidas™, across sports or general fitness.

Although FIG. 7 shows a rubber flexible wrap, the other wraps or grips may also include one or more finger loops.

Figure 8:
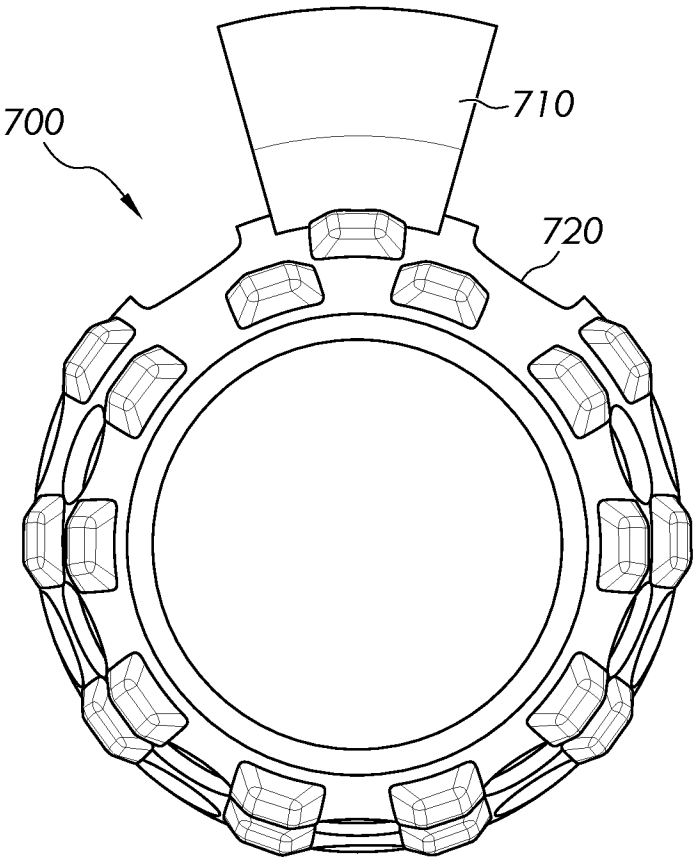
FIG. 8 illustrates an exemplary front view of a hand strap or warp for a weight unit, according to some embodiments.

FIG. 8 illustrates an exemplary front view of the rubber flexible wrap 700, according to some embodiments of the disclosure.

Figure 9:
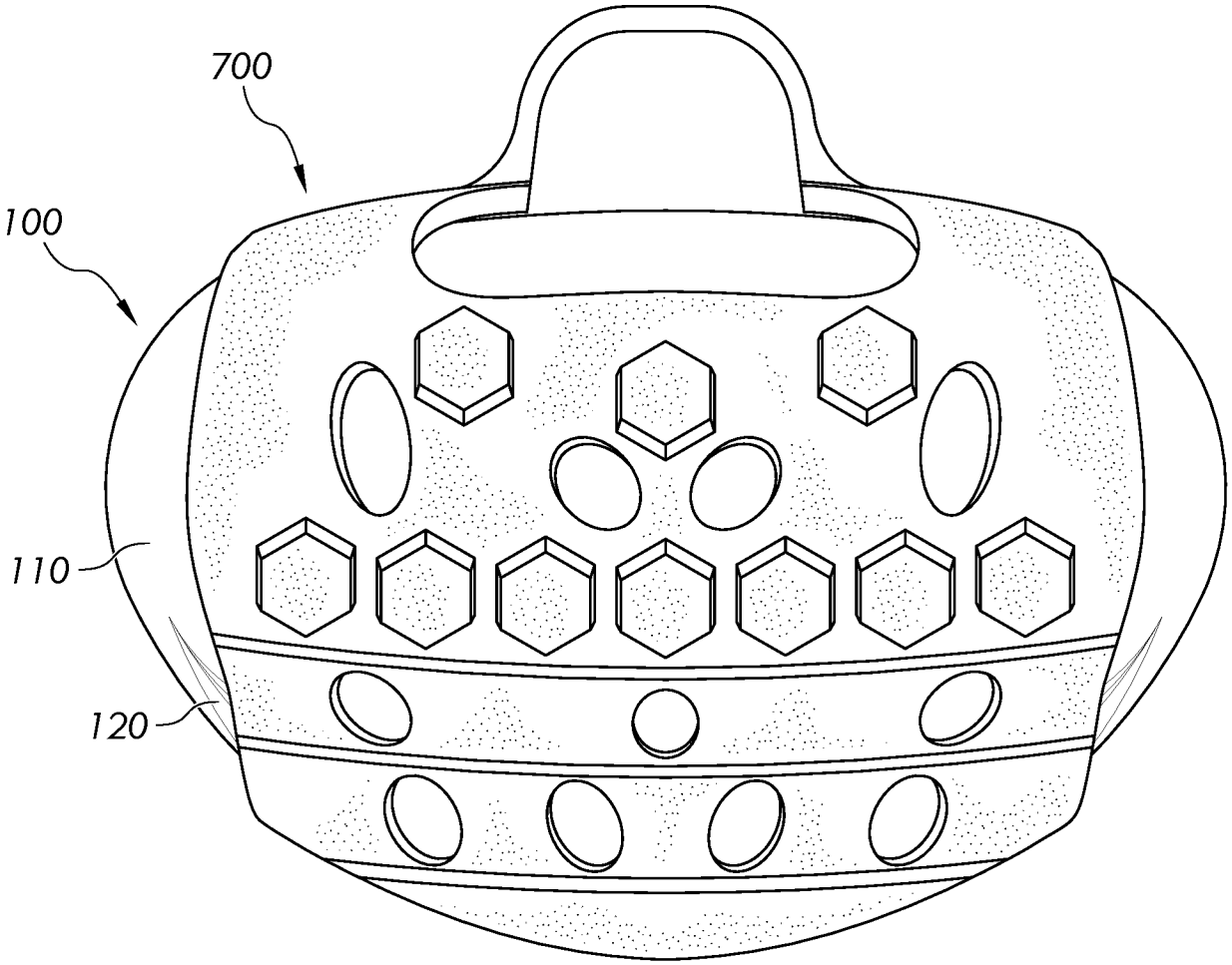
FIG. 9 illustrates an exemplary perspective view of a weight unit enclosed with the hand strap or wrap, according to some embodiments.

FIG. 9 illustrates an exemplary view of the weight unit 100 enclosed (or wrapped) with the rubber flexible wrap 700, according to some embodiments of the disclosure.

Figure 10:
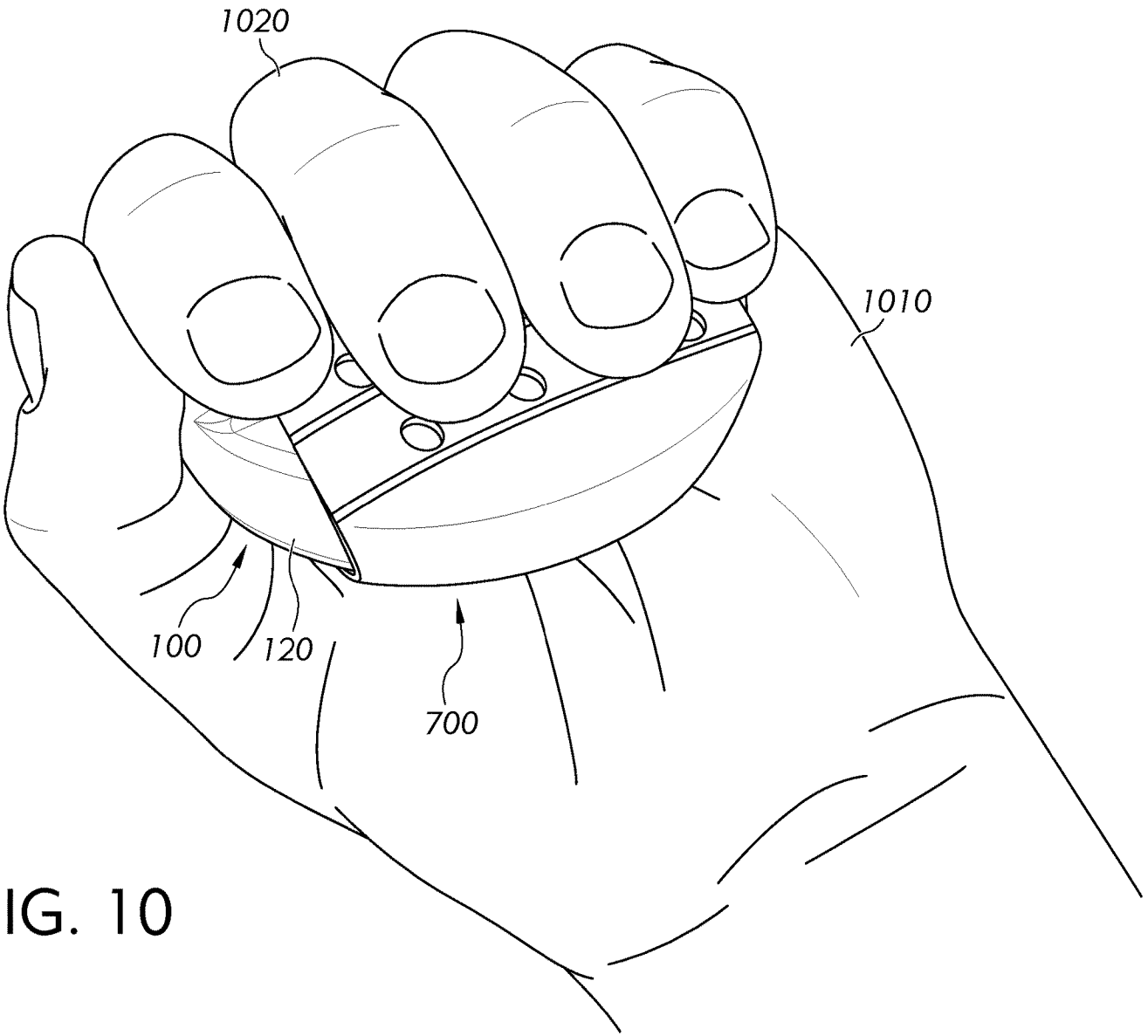
FIG. 10 illustrates an exemplary view of the exercise weight unit enclosed with the hand strap or wrap and being held by a user's hand, according to some embodiments.

FIG. 10 illustrates an exemplary view of the exercise weight unit 100 enclosed (or wrapped) with the rubber flexible wrap 700 and being held by a user's hand 1010, according to some embodiments of the disclosure. Not shown is the finger loop 710 loops around the middle finger 1020 of the user's hand.

Figure 11:
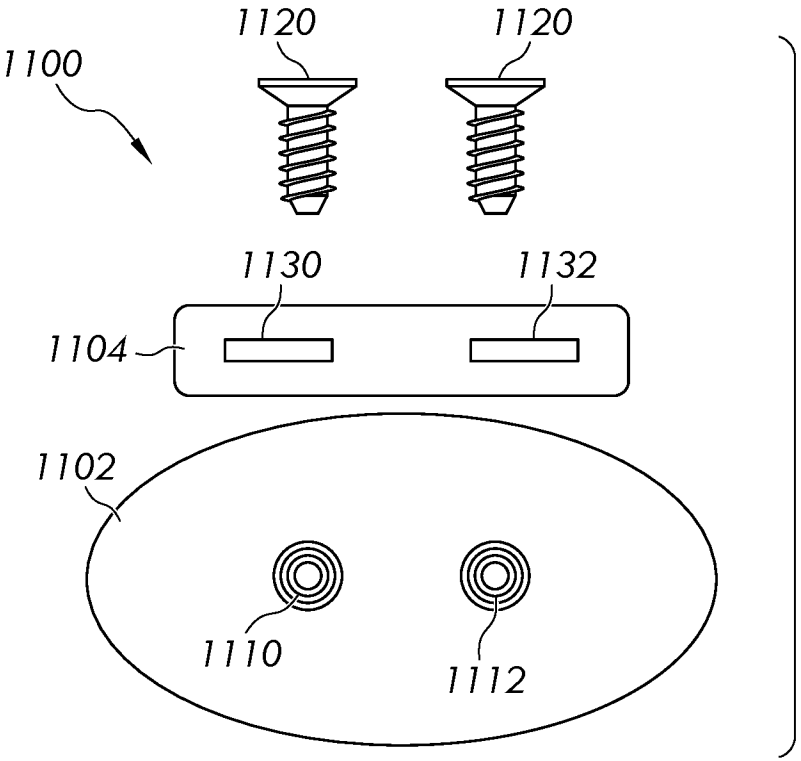
FIG. 11 illustrates an exemplary top view of an exercise weight unit with a detachable finger loop, according to some embodiments.

FIG. 11 illustrates a handheld exercise weight unit 1100, according to some embodiments of the disclosure. In some embodiments, the handheld exercise weight unit 1100 may include a rounded egg or oval shaped weight unit main body 1102, and a finger loop grip strap 1104 that may be removably affixed to the weight unit main body 1102. In some embodiments, the main body 1102 may include two drill holes 1110 and 1112 such that the adjustable leather strap 1104 may be affixed to the main body 1102 by screws 1120 through elongated openings 1130 and 1132. The elongated openings 1130 and 1132 allow the strap 1104 to be adjustable. In some embodiments, the finger loop grip strap 1104 may be made of leather.

Figure 12:
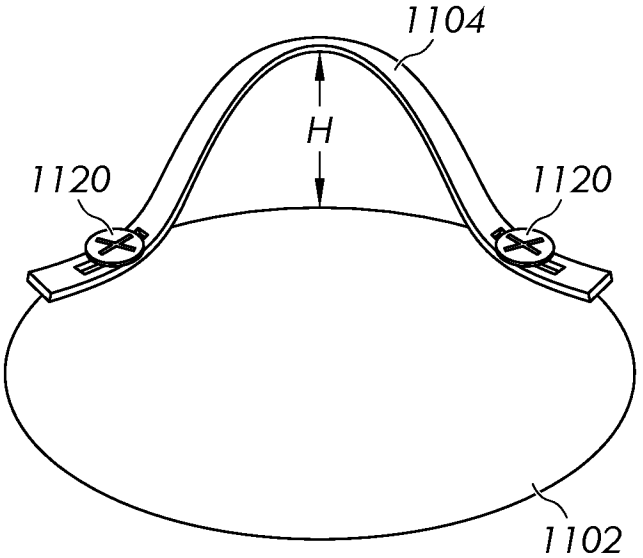
FIG. 12 illustrates an exemplary side view of an exercise weight unit with an attached detachable finger loop, according to some embodiments.

FIG. 12 illustrates an exemplary assembly of a handheld exercise weight unit 1100 with the finger loop grip strap 1104, according to some embodiments of the disclosure. The elongated openings 1130 and 1132 may slide along the corresponding drill holes 1110 and 1112, before the strap 1104 being secured to the main body 1102, to allow a desired height H to fit a finger of a user. This desired height allows a custom fit to each user's finger size.

In some embodiments, the strap 1104 may be affixed to the main body 1102 by any other suitable mechanism that allows the strap 1104 to remain secured to the main body 1102 while the strap 1104 holds a finger of a user during an exercise.

Although FIGS. 11 and 12 show the weight unit 1100 without an arc shape protrusion, the weight unit 1100 may also include an arc shape protrusion as disclosed above.

In some embodiments, the protrusion may not include an arc edge.

In some embodiments, the weight units of the various embodiments of the present disclosure may be coated in a resilient plastic, neoprene, or rubber material to ensure the proper gripping or holding thereof during aerobic exercise, decrease the slipping effect with the accumulation of sweat build up during activity, allow for the easy cleaning of the weight units with soap and water after use, protect the weight unit chip or tag from damage during use or cleaning, and to protect the weight from getting scratched or damaged if dropped or hit by another object.

In some embodiments, the present disclosure may include a sweat resistant cover or wrap for the weight unit made of resilient plastic or rubber in various colors or prints to add gripping points as well as marketing or branding opportunities including: company logos or slogans, university colors and logos, colors symbolizing special events such as the Susan Komen Race for the Cure™, and any other print or color that relates to individuals in a special or meaningful way.

In some embodiments, the weight unit may have an inner core and an outer core of varying metals or casted layers within the modular unit to achieve the specific weight and shape of the unit as well as create a barrier or protective layer around softer but denser metals such as lead.

In some embodiments, the present disclosure may provide a RFID tracking tag/microchip or other tracking device or system thereof which may be embedded within a weight unit, and that communicates to a device, for example, a smart phone, smart watch, or similar device to automatically identify the individual or combined continuous weight values during upper body movements and/or exercise.

In some embodiments, the weight unit, for example the main body, may have a weight shell with varying insert weights that may be locked therein or removed therefrom to increase or decrease weight accordingly during physical activities.

In some embodiments, the present disclosure may include motion tracking sensors such as gyroscopes and accelerators within the weight unit, a smart watch, or other monitoring devices that are worn on the wrist or forearm in combination with inputs from the user (e.g., height) to track individual upper body motion of the user through algorithms computing the X, Y, Z axis points (roll, pitch, and yaw), and rotational acceleration data points of each movement performed by the user.

In some embodiments, the data collected from the gyroscope and accelerator unit, in conjunction with the continuous held weight values, may be visible to the user either on a smart monitoring device or uploaded to a smart phone, tablet, laptop, or computer in such a way that it is easy to read and understand. Such a format may include, for example: graphs, charts, total arm movements by category and muscle group, total pounds lifted per hour, total pounds lifted, total pounds lifted per muscle group, total pounds lifted per individual exercise, etc. In some embodiments, the total data generated from the gyroscope and the accelerator, in conjunction with the varying held weight, shall provide an overall analysis displayed on either the smart monitoring device itself or uploaded to a laptop, tablet, phone, or computer depicting an animated male or female digital body display with the intensity of the exercises and the muscle groups used to perform said exercises identified by color of intensity and performance. For example, if an individual performed mostly all bicep curls during their aerobic activity, the digital body would show red in the bicep muscle for high intensity, yellow in the forearm muscle group for medium intensity, and green for low performance or intensity in the remaining upper body muscle groups. Furthermore, by rotating the digital body with the swipe of a finger on a display window, the digital body rotates to show muscle groups located on the individual's back to complete the entire upper body muscle groups. The digital body may also include lower body muscle groups, utilizing data generated from the sensors to track muscle activity during aerobic exercise such as walking, jogging, running, running stairs, or hiking, etc.

In some embodiments, data collected may be calculated to determine calories burned by the user during the physical activity. In some embodiments, the device may use the Harris-Benedict method as follows:

BMR Men: =66+(6.23×weight in pounds)+(12.7×height in inches)−(6.8×age)

BMR Women: =655+(4.35×weight in pounds)+(4.7×height in inches)−(4.7×age)

The Harris-Benedict equations revised by Mifflin and St Jeor in 1990:

Men BMR=(10×weight in kg)+(6,25×height in cm)−(5×age in years)+5 Women BMR=(10×weight in kg)+(6,25×height in cm)−(5×age in years)−161.

For example, C=(0.4472×H−0.05741×W+0.074×A−20.4022)×T/4.184. C is the number of calories that the user burned, H is the user's average heart rate, W is the user's weight, A is the user's age and T is the length of the user's exercise session in minutes. Assume that the user is a 28-year-old female weighing 146 pounds. The user's average heart rate during an exercise session that lasted 36 minutes was 138 bpm. The user burned C=(0.4472×138−0.05741×146+0.074×28−20.4022)×36/4.184=301 calories.

In some embodiments, the Katch & McArdle method may be used as follows.

BMR (Men+Women)=370+(21.6*Lean Mass in kg)

Lean Mass=weight in kg−(weight in kg*body fat %)
1 kg=2.2 pounds, so divide the user's weight by 2.2 to get the user's weight in kg Activity Multiplier (Both HB+KA Method use same activity multiplier)

Little or No Exercise, Desk Job
1.2×BMR
1.3 Light Exercise, Sports 1 to 3 Times Per Week
1.375BMR
1.376 Moderate Exercise, Sports 3 to 5 Times Per Week
1.55 BMR
1.56 Heavy Exercise, Sports 6 to 7 Times Per Week
1.725×BMR It should also be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

To the extent the embodiments disclosed herein include or operate in association with memory, storage, and/or computer readable media, then that memory, storage, and/or computer readable media are non-transitory. Accordingly, to the extent that memory, storage, and/or computer readable media are covered by one or more claims, then that memory, storage, and/or computer readable media is only non-transitory.

While the embodiments are susceptible to various modifications and alternative forms, specific examples thereof have been shown in the drawings and are herein described in detail. It should be understood, however, that these embodiments are not to be limited to the particular form disclosed, but to the contrary, these embodiments are to cover all modifications, equivalents, and alternatives falling within the spirit of the disclosure. Furthermore, any features, functions, steps, or elements of the embodiments may be recited in or added to the claims, as well as negative limitations that define the inventive scope of the claims by features, functions, steps, or elements that are not within that scope.

It is to be understood that this disclosure is not limited to the particular embodiments described herein, as such may, of course, vary. It is also to be understood that the terminology used herein is for the purpose of describing particular embodiments only and is not intended to be limiting.

As used herein and in the appended claims, the singular forms "a," "an," and "the" include plural referents unless the context clearly dictates otherwise.

In general, terms such as "coupled to," and "configured for coupling to," and "secure to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

As used herein, the term "and/or" placed between a first entity and a second entity means one of (1) the first entity, (2) the second entity, and (3) the first entity and the second entity.

Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B", when used in conjunction with open-ended language such as "comprising" can refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

What is claimed is:

1. An exercise weight unit adapted to be handheld and palm-centered, comprising:

an elongated main body having a first end and a second end, a central portion, and a central axis through the first end and the second end, wherein the elongated main body tapers towards each end of the first end and the second end from opposite ends of the central portion, giving the main body a generally oval contour, each end of the first end and the second end terminates in a rounded terminal end, the terminal ends forming part of the generally oval contour;

a protrusion extended away from an outer surface of the main body and forming an arc shape that extends from the first end of the main body to the second end of the main body along a base;

a wrap covering at least a portion of the elongated main body and the protrusion; and a finger loop coupled to the elongated main body and forming a portion of the wrap, and wherein the taper is adapted to allow the exercise weight unit to be held centrally within a user's palm.

2. The exercise weight unit of claim 1, wherein a width of the protrusion is smaller than a diameter of the main body at the central portion.

3. The exercise weight unit of claim 1, further comprising at least one of a RFID tracking tag and a microchip tracking device.

4. The exercise weight unit of claim 1, wherein the main body comprises of a weight shell with varying insert weights, the insert weights configured to be locked therein or removed therefrom.

5. The exercise weight unit of claim 1, further comprising one or more motion sensors.

6. The exercise weight unit of claim 1, wherein the finger loop is coupled to the wrap at the central portion of the elongated main body.

7. The exercise weight unit of claim 6, wherein the wrap is removably and fitly wrapped around the elongated main body of the exercise weight unit.

8. The exercise weight unit of claim 6, wherein the wrap further comprises one or more raised nodules.

* * * * *